US005809878A

United States Patent [19]

Proctor

[11] Patent Number: 5,809,878

[45] Date of Patent: Sep. 22, 1998

[54] RIGID SHEET PRINTER/FEED BOARD ASSEMBLY

[75] Inventor: Arthur E. Proctor, Bailey, Mich.

[73] Assignee: BecMar Corp., Bailey, Mich.

[21] Appl. No.: 933,207

[22] Filed: Sep. 16, 1997

[51] Int. Cl.[6] ..... B41F 15/08; B65H 9/06; B65H 5/16

[52] U.S. Cl. ..... 101/124; 101/242

[58] Field of Search ..... 101/117, 118, 101/124, 126, 241, 242, 239, 114, 115, 116; 271/271, 269, 245

[56] References Cited

U.S. PATENT DOCUMENTS

| | | | |
|---|---|---|---|
| 2,606,492 | 8/1952 | Black | 101/124 |
| 3,120,180 | 2/1964 | Black et al. | 101/124 |
| 3,538,846 | 11/1970 | Jaffa | 101/123 |
| 3,941,053 | 3/1976 | Black et al. | 101/124 |
| 3,977,269 | 8/1976 | Linley, Jr. | 74/441 |
| 4,771,690 | 9/1988 | Force | 101/124 |
| 5,101,722 | 4/1992 | Nagatani | 101/124 |

*Primary Examiner*—J. Reed Fisher

*Attorney, Agent, or Firm*—Price, Heneveld, Cooper, DeWitt & Litton

[57] ABSTRACT

A stencil screen printing apparatus for printing rigid sheets comprising an intermittently rotatable cylinder, a reciprocable stencil screen frame, a power drive for the cylinder and stencil screen frame to move them in synchronism with each other, a vertically reciprocable squeegee above the cylinder, infeed belts for feeding rigid sheets along a path toward the cylinder, a variable speed drive for the infeed belts, and controls to slow the drive for an increment of the belt advancement and then stop the drive, sheet pushers and a variable speed servo screw drive operably connected to the sheet pushers, the sheet pushers being forwardly shiftable toward the cylinder to push the rigid sheet front edge beneath the squeegee and the stencil screen frame, and side registry alignment pusher tabs and a variable speed servo screw drive for laterally aligning the rigid sheet relative to the cylinder, whereby the sheet pushers and the side registry tabs simultaneously align the sheet at 90° locations for accurate printing on the sheet.

14 Claims, 4 Drawing Sheets

RIGID SHEET PRINTER/FEED BOARD ASSEMBLY

BACKGROUND OF THE INVENTION

Stencil screen printing presses for printing sheet stock or web stock are well known. Typically, these presses, when printing sheets, usually paper sheets, use a revolving print cylinder which has mechanical grippers to grip the front edge of the sheet, with or without the assistance of vacuum grippers, to pull the sheet around the rotating cylinder beneath a squeegee and a linearly advancing stencil screen. Typical structures are shown, for example, in U.S. Pat. Nos. 3,941,053 and 3,120,180.

Lateral alignment devices are used to push or pull the sheet into correct alignment before the sheet is gripped. With proper sheet feed control, alignment and gripping actions, the sheets can be printed at a high rate of output.

Stencil screen printing of rigid sheet stock as of cardboard, polymer or thin metal, however, presents other problems which usually result in a much lower product output rate. The rigid sheets, if rapidly fed into the press, have substantial momentum so that rapid stopping, alignment and restarting of the sheets for registration and printing present substantial problems. Consequently, for these reasons at least, stencil screen printing of rigid sheet stock typically involves a low output rate.

One known apparatus for stencil screen printing of rigid sheet stock is set forth in U.S. Pat. No. 4,771,690. This apparatus employs mechanical latching devices which repeatedly latch a heavy assemblage of components weighing 20 to 30 pounds, rapidly propel this assemblage with the stencil screen frame, and slam it to a stop at the end of the stroke, and mechanism to rapidly return the heavy assemblage and cause an abrupt stop at the end of the return stroke. Consequently, the mechanism is subject to great wear and emits objectionable noise, especially at maximum output rates of about 700–800 sheets per hour. In addition, the apparatus requires a second set of stops adjacent the print cylinder, against which the rigid stock sheets slam with each sheet infeed. This second set of stops necessitates a high screen displacement, i.e., a high so-called "off contact" of the screen from the cylinder so that the screen will be clear of these stops. This high off-contact greatly shortens the stencil screen life. Another difficulty with this apparatus is that of adjusting the alignment of the sheet pushers with respect to the second set of sheet stops.

SUMMARY OF THE INVENTION

The present invention provides a unique, rigid sheet, stencil screen printing press that can more rapidly and accurately screen print rigid sheets as of metal, plastic or cardboard. The sheets are rapidly fed in by belts and then slowly brought into abutment with a pair of stops, and laterally pre-registry aligned. The stops then retract to allow the belts to advance the sheet forwardly of recessed pushers which subsequently protrude up and push the sheet until its front edge is aligned beneath the squeegee and the front end of the stencil screen. These pushers/advancers are rapidly advanced by a servo drive over the stationary belts until near the end of the stroke, and then slowly advanced to the end of the stroke. The sheets are aligned both longitudinally by the advancers and laterally by servo drive side register roller tabs, so the front edge is accurately aligned with and subsequently held by a lowering squeegee. The squeegee is lowered to grip the stencil screen and sheet to the cylinder, following which the cylinder is rotated and the stencil screen is linearly advanced, in synchronism with each other. With the screen being held by the squeegee against the sheet, and the cylinder periphery and the screen moving at the same rate, the gripped sheet is advanced past the squeegee to print the sheet. Operation of the novel apparatus has demonstrated an output capacity of even 1200–1500 sheets per hour, at a registration accuracy within a few thousandths of an inch. The advancers are servo and screw fed with variable speed actuation. They can also be quickly initially set up, and/or adjusted longitudinally, by an outboard actuator, to accommodate particular sheet sizes. The side registry is servo and screw operated with variable speed actuation. The advancers can also be readily longitudinally adjusted relative to each other so as to be parallel to the squeegee.

The novel apparatus enables low off contact displacement of the stencil screen, providing long life to the stencil screen.

These and other features, advantages and objects of the present invention will be further understood and appreciated by those skilled in the art by reference to the following specification, claims and appended drawings.

DETAILED DESCRIPTION OF PREFERRED EMBODIMENT

Figure 4:
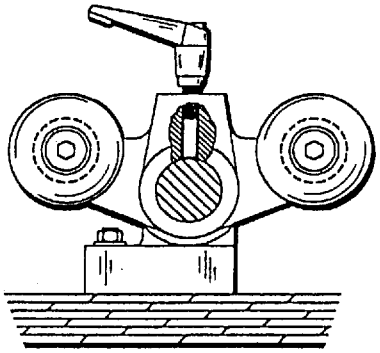
FIG. 4 is an enlarged, fragmentary, sectional view taken on plane IV—IV of FIG. 3.
Figure 4:
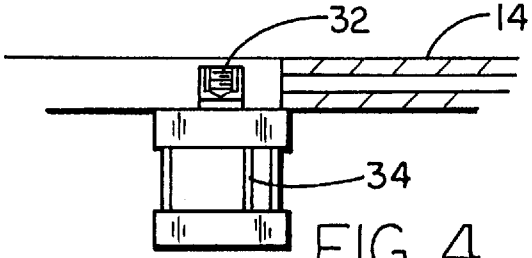
Figure 5:
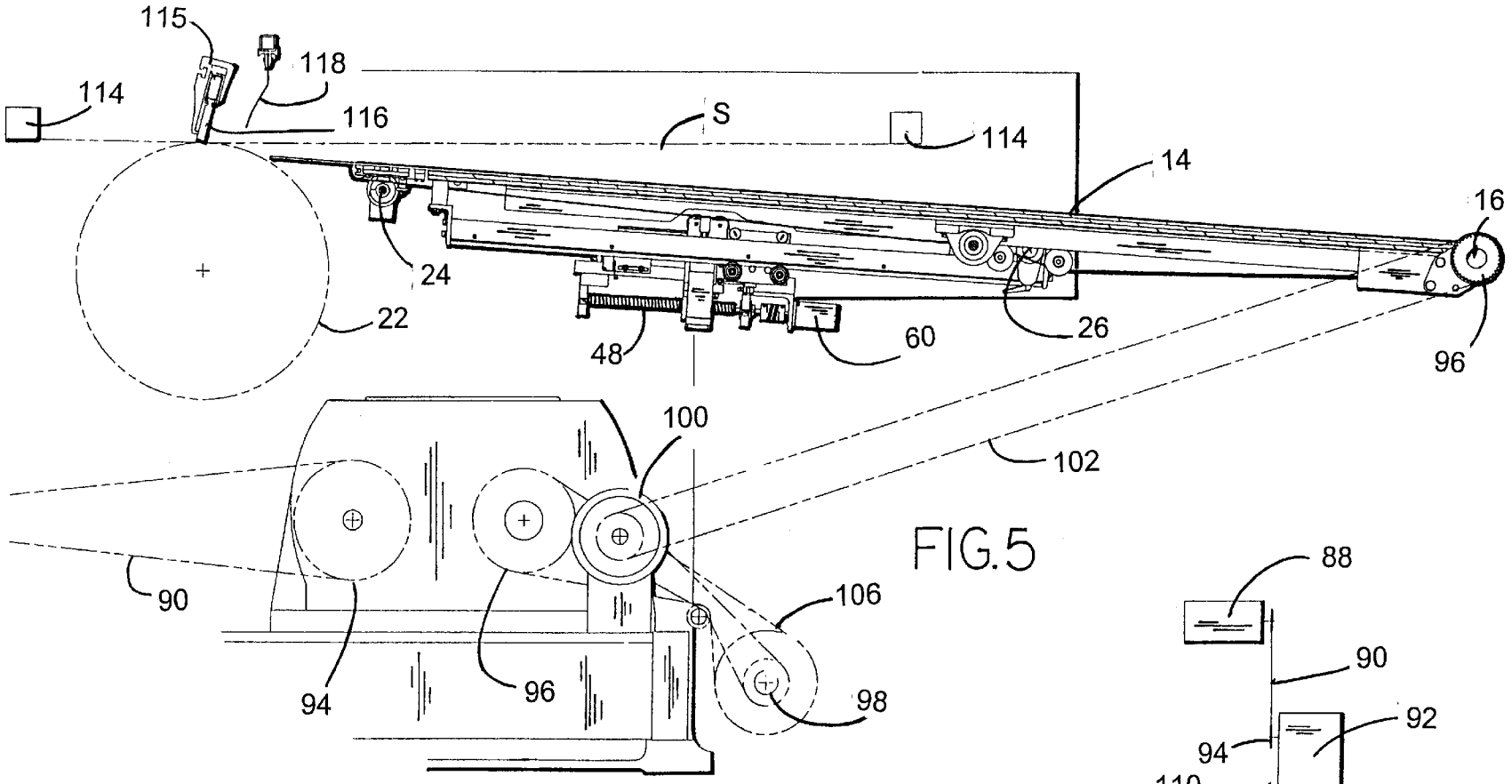
FIG. 5 is a side elevational view from the opposite side as FIG. 2, also showing other drive components as well as the print cylinder, squeegee and stencil screen frame.

Referring now specifically to the drawings, the stencil screen printing apparatus 10 specifically includes a basic support frame 12 composed of a plurality of support elements for mounting the various functional components of the apparatus. These functional components include a feed board 14 having at the infeed end thereof a transverse feed board drive shaft 16 (FIG. 5). This drive shaft rotates an elongated, transversely oriented belt drive roller 18. A plurality of endless feeder belts, here shown to be five in number, are engaged by and travel around roller 18 to be advanced by the roller. These five belts in this particular embodiment are shown to include three centrally positioned belts 20 which are spaced from each other and parallel to each other, and a pair of outer belts 21, also spaced from and parallel to the others but laterally adjustable relative to belts 20 to accommodate different width sheets. Belts 20 and 21 extend over the top surface of feed board 14 for advancement of the rigid stock sheets from roller 18 toward the opposite end of the feed board where print cylinder 22 is located (FIG. 5), as noted by the arrows in FIG. 1. Above the print cylinder 22 is a conventional squeegee subassembly 115 retaining a squeegee 116 for pressing a stencil screen S against cylinder 22 during printing. Screen S is mounted in a conventional stencil screen frame 114 for movement across cylinder 22 beneath squeegee 116 which is vertically shiftable but longitudinally stationary in conventional fashion. A flood blade 118 of conventional type can be used to spread ink over the screen during the reverse stroke by the stencil screen frame. The endless belts, in conventional fashion, extend over the feed board and around an idler rollers 24 (FIG. 5), then back underneath the feed board, through belt tighteners 26 (FIGS. 2 and 5) and back to infeed roller 18. Downstream of roller 18 is a pair of upper biasing rollers 28 (FIG. 1) for biasing the sheet stock down onto the feed board and belts. Downstream from these biasing rollers is a pair of stabilizing rollers 30, preferably of cylindrical brush-type material, for retaining the rear edge of a sheet against reversal of the sheet when the belts propel the sheet against a pair of stops 32, preferably rubber tipped. Stops 32 (FIGS. 1 and 4) are spaced laterally of each other. They are elevatable from a lowered position beneath the top surface of feed board 14, to an elevated position above the top surface of feed board 14 and belts 20 and 21, this raising and lowering being by action of fluid cylinder actuators 34 (FIGS. 3 and 4), or the equivalent. Upstream of stops 32 is a side pre-registry device including a laterally, i.e., transversely movable, pusher finger 36 (FIG. 1), and a fluid cylinder 38 mounted to the frame and oriented to cause pusher finger 36 to move transversely relative to the direction of sheet feed, inwardly and outwardly. The purpose of this is to obtain a general alignment of the sheet which is engaging stops 32, so that the rectangular sheet will have a generally correct alignment relative to the direction of feed.

Downstream of stops 32 is a pair of pusher or advancer upright fingers 40 which can be retracted downwardly to be recessed downwardly below the upper surface of feed board 14 or elevated upwardly above the upper surface of feed board 14 and above belts 20 and 21 so as to be able to engage the rear edge of a rigid sheet to be printed. These two pusher fingers of hardened material are mounted on the vertical piston rods of fluid cylinders 42 (FIG. 3) which in turn are mounted on a pusher platform 44 extending transversely beneath the feed board. Attached to platform 44 is a screw collar or nut 46 in threaded engagement with a lead screw 48 extending lengthwise of the feed board, i.e., oriented in the direction of infeed for the sheet. This screw and screw collar employ an anti-backlash connector, preferably of the type in U.S. Pat. No. 3,977,269 incorporated by reference herein. These components are available from Universal Thread Grinding Company, Fairfield, Conn. The screw is preferably that designated ½-.400-8".

A pair of micro switches 43 and 45 are mounted adjacent screw 48 for engagement by platform 44 during advancing feed movement. Switch 43 causes the servo motor 60 and the screw drive to shift from a faster to a slower speed, while switch 45 stops servo motor 60 and the screw drive. A third micro switch 47 stops the servo motor at the end of reverse movement of the mechanism. This third switch 47 is mounted on carriage 52. Screw 48 is rotatably mounted at its ends to an elongated support 50 which in turn is attached to a transverse carriage 52. The opposite ends of carriage 52 include rollers 54 guided by a pair of parallel, elongated, longitudinally oriented tracks 56. Also mounted on support 50 is the variable speed servo motor 60 connected to screw 48 for rotating the screw and thereby causing collar 46 to move therealong in either direction for advancing platform 44, pusher elevators 42, and pusher fingers 40 toward the print cylinder, or return to the initial position. Carriage 52 has a nut which is engaged with a larger longitudinally extending ball screw 66 mounted at its opposite ends to the printing apparatus frame. Screw 66 is connected to a gear box 68 (FIG. 3) which in turn is connected with a transverse drive shaft 70 having an end extending outboard of one side of apparatus 10. A hand wheel and crank actuator 72 are attached to this outer end of shaft 70. This enables the entire pusher assembly to be initially adjusted by the press operator to a particular position to accommodate the specific length of sheet stock to be printed.

Figure 1:
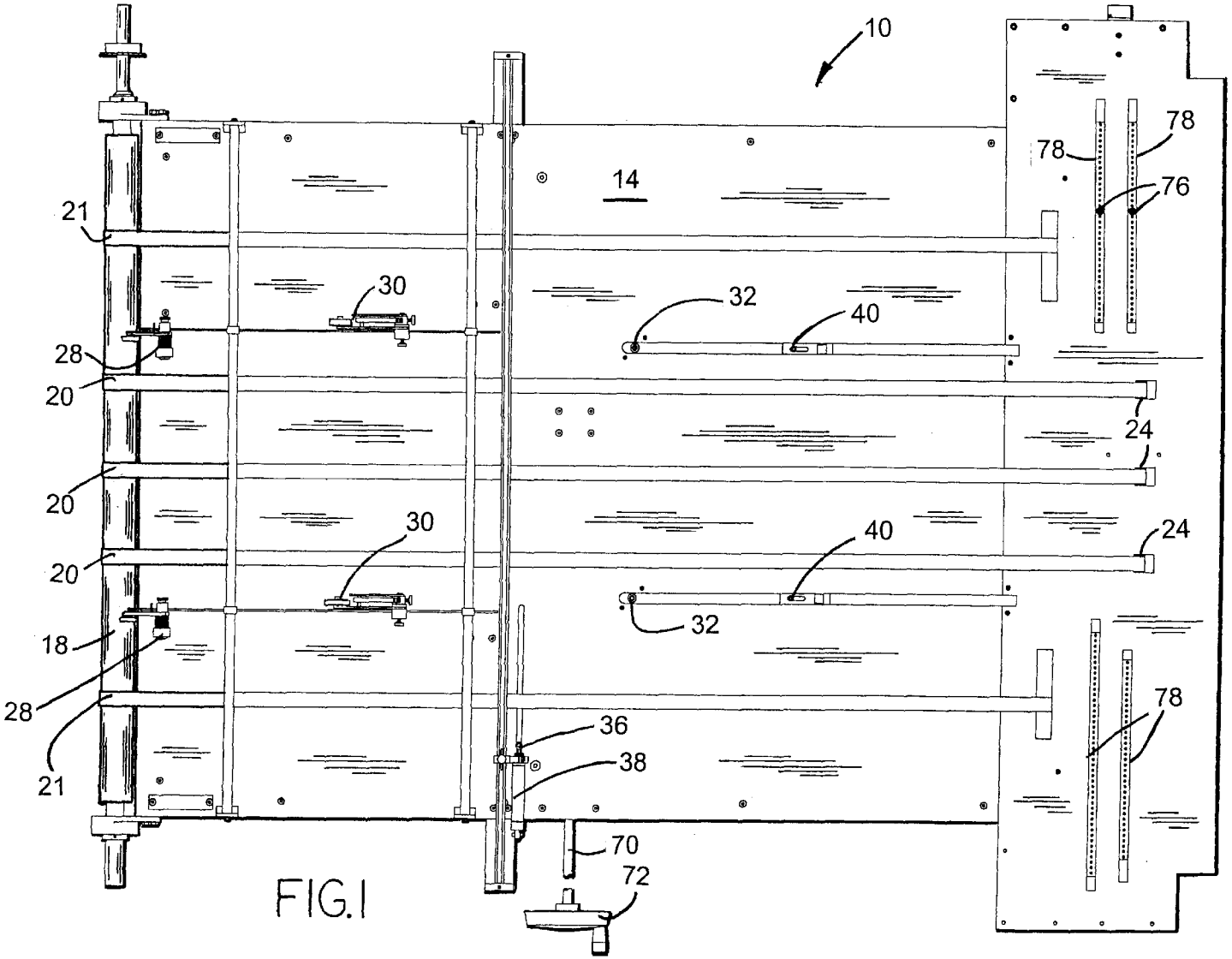
FIG. 1 is a top plan view of the sheet feed mechanism.
Figure 2:
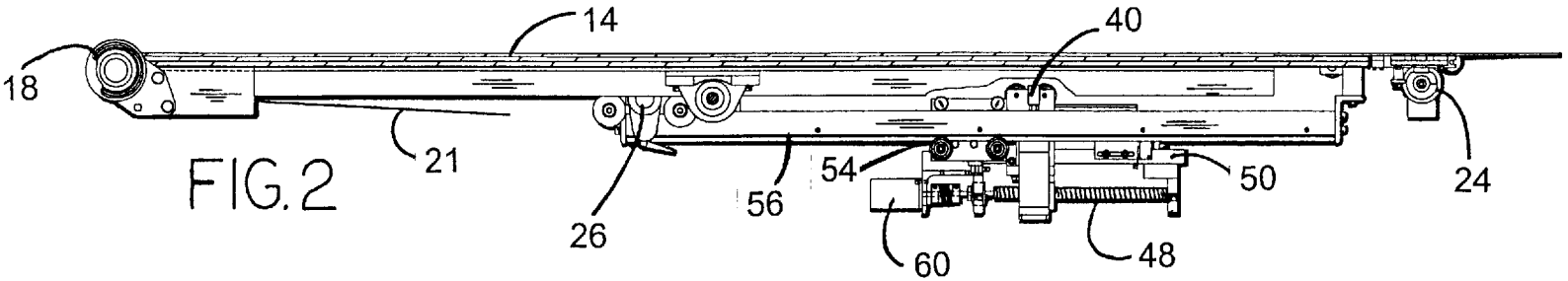
FIG. 2 is a side elevational view of the mechanism in FIG. 1.
Figure 3:
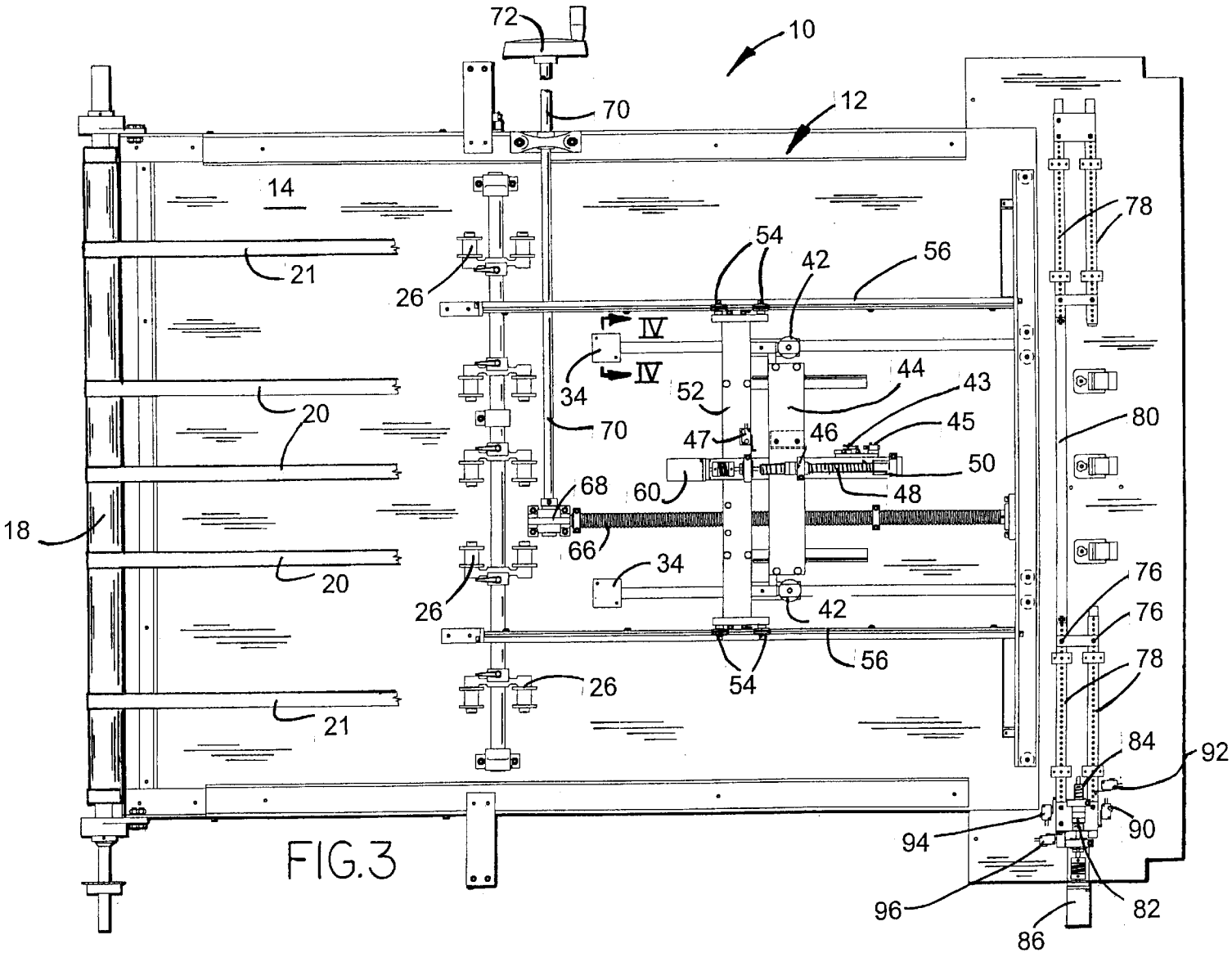
FIG. 3 is a bottom view of the mechanism in FIGS. 1 and 2.

Adjacent print cylinder 22 is the side registry mechanism including a pair of longitudinally spaced sheet engagement push tab rollers 76 (FIG. 1) positioned along one side of the sheet stock. These rollers are mounted on a pair of elongated transverse bars 78 which have a multiple of selective orifices along their length for selected positioning of the tabs thereon. Preferably there are duplicate bars 78 on both sides, as shown in FIGS. 1 and 3, interconnected by a connector rod 80 (FIG. 3), and laterally movable to allow registry from either side. Movement of these bars and tab rollers toward the sheet is accurately controlled by having a screw collar 82 attached to bars 78 and engaging a transverse screw shaft 84, one end of which is connected to a variable speed servo motor 86. This servo motor may be of the same type as servo motor 60. A pair of control micro switches 90 and 92 are activated with extended transverse movement of the side alignment bars toward the sheet so as to first slow the servo motor and screw drive near the end of the stroke and then stop the servo motor and screw drive at the end of the stroke. A similar pair of micro switches 94 and 96 slow and then stop the servo motor during the reverse outward movement of the supports and registry tabs.

Operation of the longitudinal pushers and operation of the side guide alignment tabs are synchronized with each other so that alignment takes place simultaneously at 90°, causing the front edge of a sheet to be very accurately oriented beneath the squeegee. This accuracy has been found to be within 0.002 to 0.003 inch repeatedly, even when printing rigid sheets at the high rate of 1200 or so per hour. Such accuracy is particularly important when successively printing a plurality of colors on the sheet stock.

Figure 6:
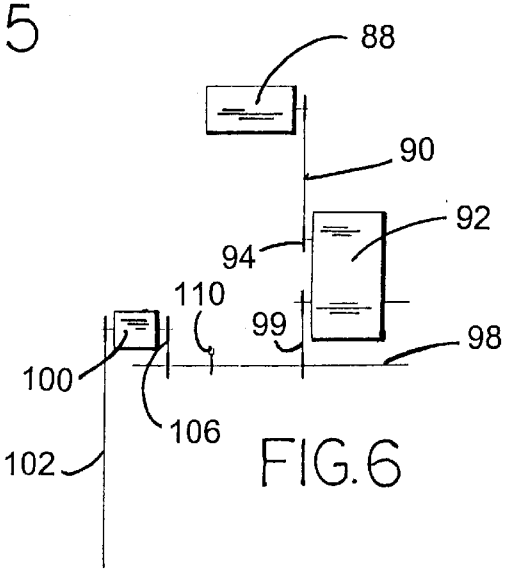
FIG. 6 is a schematic plan view of the drive components and control switching.

Referring now to FIGS. 5 and 6, the primary drive apparatus for the stencil screen press is shown, partially schematically. The main drive motor 88 drives an endless belt 90 which powers a gear reducer assembly 92 by way of a pulley 94. The gear reducer in turn operates sprocket 96 which powers the main drive jack shaft 98 through suitable roller chain 99. Jack shaft 98 drives an electric clutch brake 100 by chain 106. The clutch brake is connected by endless chain 102 to feed board drive shaft 16. This clutch brake drive, which may be a Dodge brand DMSC-210-90, operates the feed belts 20 and 21 at the desired rate. It then immediately stops the belts when the rigid sheet stock strikes stops 32 and is laterally prealigned, reactivates to push the sheet stock forwardly of pushers 40 and then immediately stops while the pushers 40 advance the sheet stock over the stationary belts to the position where the front edge of the sheet stock is beneath the squeegee and in alignment with the squeegee through the dual action of the pushers which act as longitudinal registry mechanism, and the side registry push tab rollers 76. During subsequent forward rotation of print cylinder 22 and stencil screen frame 114 with its stencil screen S, the print stock is pressed between the stencil screen and cylinder 22 by the squeegee 116, the synchronized forward motion of print cylinder 22 and stencil frame 114 causes the sheet stock to advance beneath squeegee 116 so that printing occurs in a fashion which is well known. As the sheet stock is advanced between the squeegee and the print cylinder, its side edge is constantly guided by the minimal friction roller tabs 76 so as to not skew the sheet during this advancement.

Figure 7:
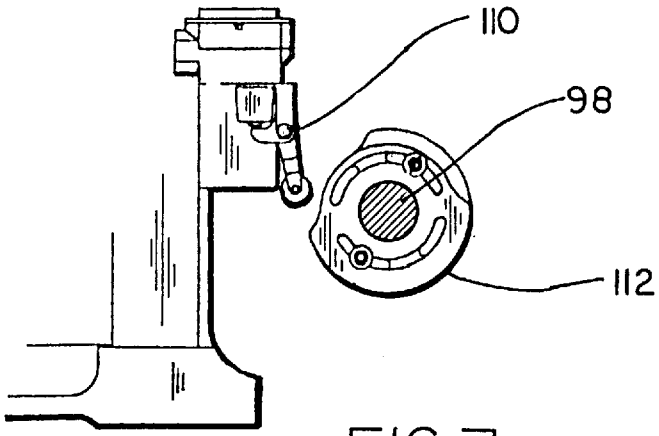
FIG. 7 is a fragmentary, elevational view of control cam and switch components.

FIG. 7 shows main drive jack shaft 98 relative to cycle control cam 112 which it operates. The cam in turn controls the cycle control limit switch 110 so that all of the components operate in synchronism during the forward motion. During the return motion, print cylinder 22 rotates in reverse to its starting position, screw 48 rotates in reverse to return pushers 40 to the initial position, and side registry screw 84 rotates in reverse to move the side registry roller tabs 76 outwardly. Main drive jack shaft 98 is operably connected to cylinder 22 and stencil screen frame 114 to drive them in synchronism, as shown for example in U.S. Pat. Nos. 3,120,180 and 3,941,053, incorporated herein by reference. The vertical reciprocation of squeegee subassembly 115 and squeegee 116 is conventional, as taught by example in U.S. Pat. Nos. 3,120,180 and 3,941,053 noted above.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A stencil screen printing apparatus for printing rigid sheets comprising:

an intermittently rotatable cylinder;

a stencil screen frame above and adjacent said cylinder for holding a stencil screen;

said frame being linearly reciprocable back and forth over said cylinder and having a forward end;

a power drive operably associated with said cylinder and said stencil screen frame to move them in synchronism with each other;

a vertically reciprocable squeegee above said cylinder;

infeed belts for feeding rigid sheets along a path toward said cylinder, a variable speed drive for said infeed belts, and controls to slow said drive for an increment of the belt advancement and then stop said drive;

alignment stops shiftable vertically into said path to stop a rigid sheet on said infeed belts;

said stops being vertically shiftable out of said path for further advancement of the rigid sheet thereover;

a pre-register side alignment guide at said stops for laterally generally aligning the rigid sheet;

sheet pushers and a servo screw drive operably connected to said sheet pushers, said sheet pushers being vertically shiftable up behind the sheet, and forwardly shiftable toward said cylinder to push and linearly align the rigid sheet front edge beneath said squeegee and the forward end of said stencil screen frame; and side registry alignment tabs for aligning said rigid sheet relative to said cylinder, whereby said squeegee and said cylinder, with rotational advancement of said cylinder and linear advancement of said stencil screen, cause the rigid sheet to linearly advance relative to said squeegee and said cylinder, for printing thereon.

2. The apparatus in claim 1 wherein said sheet pusher servo screw drive comprises a rotational screw, a servo motor operably connected to said rotational screw to rotate said screw, and a collar on said screw and connected to said pushers to cause said servo motor to drive said pushers.

3. The apparatus in claim 2 wherein said pusher drive servo motor is a variable speed motor and said apparatus includes switches actuated responsive to movement of said collar and operably associated with said pusher drive servo motor to slow and then stop said servo motor.

4. The apparatus in claim 3 wherein said side registry guide mechanism comprises sheet engagement tabs, a servo motor operably connected to a transverse screw, and a collar on said transverse screw and operably connected to said sheet engagement tabs.

5. The apparatus in claim 4 wherein said side registry servo motor is a variable speed motor, and said side registry guide mechanism includes switches actuated responsive to movement of said side registry collar for causing said side registry servo motor to slow and then to stop for controlled accurate side registry of the sheet.

6. The apparatus in claim 4 wherein said side registry guide mechanism comprises a pair of roller tabs to allow sheet movement therealong without sheet skewing during printing advancement of the sheet.

7. The apparatus in claim 1 including an outboard control operably associated with said sheet pushers and operably connected thereto for longitudinally adjusting said sheet pushers to accommodate sheet length.

8. The apparatus in claim 1 wherein said pushers are longitudinally adjustable relative to each other.

9. The apparatus in claim 8 including a longitudinally movable carriage mounting said pushers, a longitudinal screw connected to said carriage, and an outboard actuator operably connected to said screw for longitudinally positioning said pushers in accommodation with sheet size.

10. The apparatus in claim 5 including control means to cause said pusher drive servo motor and said side registry guide servo motor to slow down and move in synchronism for effecting 90° alignment of sheet stock at said squeegee.

11. A stencil screen printing apparatus for printing rigid sheets comprising:

an intermittently rotatable cylinder;

a stencil screen frame above and adjacent said cylinder for holding a stencil screen;

said frame being linearly reciprocable back and forth over said cylinder and having a forward end;

a power drive operably associated with said cylinder and said stencil screen frame to move them in synchronism with each other;

a vertically reciprocable squeegee above said cylinder;

infeed belts for feeding rigid sheets along a path toward said cylinder;

alignment stops shiftable vertically into said path to stop a rigid sheet on said infeed belts;

said stops being vertically shiftable out of said path for further advancement of the rigid sheet thereover;

sheet pushers and a servo screw drive operably connected to said sheet pushers, said sheet pushers being vertically shiftable up behind the sheet, and forwardly shiftable toward said cylinder for pushing and linearly aligning the rigid sheet front edge beneath said squeegee and the forward end of said stencil screen frame, said servo screw drive comprising a rotational screw, a servo motor operaby connected to said rotation screw to rotate said screw, and a collar on said screw and connected to said pushers to cause said servo motor to drive said pushers;

said pusher drive servo motor being a variable speed motor and said apparatus including switches actuated responsive to movement of said collar and operably associated with said pusher drive servo motor to slow and then stop said servo motor;

side registry alignment push tabs and a transverse screw drive therefor laterally aligning said rigid sheet relative to said cylinder, simultaneously from 90° relative to said linear aligning, whereby said squeegee and said cylinder, with rotational advancement of said cylinder and linear advancement of said stencil screen, cause the rigid sheet to linearly advance relative to said squeegee and said cylinder for printing thereon.

12. The apparatus in claim 1 wherein said side registry guide mechanism comprises sheet engagement tabs, a servo motor operably connected to a transverse screw, and a collar on said transverse screw operably connected to said sheet engaged tabs, said side registry servo motor being a variable speed motor, and said side registry guide mechanism including switches actuated responsive to movement of said side registry collar for causing said side registry servo motor to slow and then to stop for controlled accurate side registry of the sheet.

13. The apparatus in claim 12 wherein said side registry guide mechanism comprises a pair of roller tabs to allow sheet movement therealong without sheet skewing during printing advancement of the sheet.

14. The apparatus in claim 12 including control means to cause said pusher drive servo motor and said side registry guide servo motor to slow down and move in synchronism for effecting 90° alignment of sheet stock at said squeegee.

* * * * *